US012163671B2

(12) United States Patent
Wang et al.

(10) Patent No.: US 12,163,671 B2
(45) Date of Patent: Dec. 10, 2024

(54) AIR CONDITIONER

(71) Applicants: CHONGQING MIDEA AIR-CONDITIONING EQUIPMENT CO., LTD., Chongqing (CN); GD MIDEA AIR-CONDITIONING EQUIPMENT CO., LTD., Foshan (CN)

(72) Inventors: Xidong Wang, Chongqing (CN); Jing Ling, Chongqing (CN); Yu Fu, Chongqing (CN); Yingjie Song, Chongqing (CN); Qiankun Liu, Chongqing (CN)

(73) Assignees: CHONGQING MIDEA AIR-CONDITIONING EQUIPMENT CO., LTD., Chongqing (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 635 days.

(21) Appl. No.: 17/429,457

(22) PCT Filed: Nov. 17, 2020

(86) PCT No.: PCT/CN2020/129410

§ 371 (c)(1),
(2) Date: Aug. 9, 2021

(87) PCT Pub. No.: WO2022/077692

PCT Pub. Date: Apr. 21, 2022

(65) Prior Publication Data

US 2022/0307701 A1 Sep. 29, 2022

(30) Foreign Application Priority Data

Oct. 13, 2020 (CN) ..... 202011088714.4
Oct. 13, 2020 (CN) ..... 202022279773.1

(51) Int. Cl.
*F24F 1/0011* (2019.01)
*F24F 1/0025* (2019.01)
(Continued)

(52) U.S. Cl.
CPC ..... *F24F 1/0011* (2013.01); *F24F 1/0025* (2013.01); *F24F 13/081* (2013.01); *F24F 13/20* (2013.01)

(58) Field of Classification Search
CPC ..... F24F 1/0011; F24F 1/0025; F24F 13/081; F24F 13/20; F24F 13/065; F24F 13/10; F24F 2140/40; F24F 1/028
(Continued)

(56) References Cited

U.S. PATENT DOCUMENTS 4,733,543 A * 3/1988 Blair ..... F24F 1/0003 62/298
5,377,503 A * 1/1995 Reedy ..... F24F 1/0014 165/137
(Continued)

FOREIGN PATENT DOCUMENTS

CN 203857566 U 10/2014
CN 205002317 U 1/2016
(Continued)

OTHER PUBLICATIONS

The European Patent Office (EPO) Extended Search Report for EP Application No. 20919371.3 May 17, 2022 9 Pages.
(Continued)

*Primary Examiner* — Avinash A Savani
*Assistant Examiner* — Ryan L Faulkner
(74) *Attorney, Agent, or Firm* — Anova Law Group, PLLC

(57) ABSTRACT

An air conditioner includes an air conditioner body including a cross-flow air duct and an air outlet in communication
(Continued)

with the cross-flow air duct, a cross-flow impeller arranged at the cross-flow air duct and located upstream of the air outlet, and an air guide assembly including an air guide member rotatable around a pivot axis at the air outlet. The air conditioner body includes a first volute and a second volute arranged opposite to each other in a cross section perpendicular to a rotation axis of the cross-flow impeller. The cross-flow air duct is located between the first volute and the second volute. A set air duct is formed between the air guide member and the first volute when an air output volume of the air conditioner is maximum. A width of the set air duct in the cross section first increases and then decreases along an air output direction.

13 Claims, 7 Drawing Sheets

(51) Int. Cl.
*F24F 13/08* (2006.01)
*F24F 13/20* (2006.01)

(58) Field of Classification Search
USPC ..... 454/233, 5, 21
See application file for complete search history.

(56) References Cited

U.S. PATENT DOCUMENTS

| | | | | |
|---|---|---|---|---|
| 6,086,324 | A * | 7/2000 | Ikeda | F04D 17/04 415/119 |
| 2017/0299207 | A1 * | 10/2017 | Trevelyan | F24F 1/035 |

FOREIGN PATENT DOCUMENTS

| | | | |
|---|---|---|---|
| CN | 105757914 | A | 7/2016 |
| CN | 108613257 | A | 10/2018 |
| CN | 208059069 | U | 11/2018 |
| CN | 110056960 | A | 7/2019 |
| CN | 110469905 | A | 11/2019 |
| CN | 110608527 | A | 12/2019 |
| CN | 110645633 | A | 1/2020 |
| CN | 211177083 | U | 8/2020 |
| CN | 211650476 | U | 10/2020 |

OTHER PUBLICATIONS

World Intellectual Property Organization (WIPO) International Search Report and Written Opinion for PCT/CN2020/129410 Jul. 15, 2021 34 pages (with translation).

* cited by examiner

AIR CONDITIONER

CROSS-REFERENCE TO RELATED APPLICATIONS

The present application is a National Stage Entry under 35 U.S.C. § 371 of International Application No. PCT/CN2020/129410, filed Nov. 17, 2020, which is based on and claims priority to Chinese Patent Application Nos. 202022279773.1 and 202011088714.4, both filed on Oct. 13, 2020, the entire contents of all of which are incorporated herein by reference.

FIELD

The present application relates to the field of air conditioning technology, and particularly to an air conditioner.

BACKGROUND

In the related art, air conditioners, such as mobile air conditioners, window air conditioners, wall-mounted air conditioners or the like adopt a cross-flow air duct component. A cross-flow impeller rotates for primary pressurization, and air is discharged through a cross-flow air duct and guided by an air guide plate at an air outlet to meet requirements of air supply angles. However, in a guide stage of the air guide plate, due to a forced change of an airflow deflecting angle, the airflow deflecting angle is large, air pressure is reduced quickly, an air supply distance is shortened, and an air volume is reduced, thus adversely affecting a heat exchange effect.

SUMMARY

The present application seeks to solve at least one of the problems existing in the related art. To this end, an objective of the present application is to provide an air conditioner that can improve an air volume, an air supply range, and an air supply distance.

The air conditioner according to embodiments of the present application includes: an air conditioner body having a cross-flow air duct and an air outlet in communication with the cross-flow air duct; a cross-flow impeller arranged at the cross-flow air duct and located upstream of the air outlet, wherein the air conditioner body includes a first volute and a second volute arranged oppositely in a cross section perpendicular to a rotation axis of the cross-flow impeller, and the cross-flow air duct is located between the first volute and the second volute; and an air guide assembly including an air guide member rotatable around a pivot axis at the air outlet, wherein a set air duct is formed between the air guide member and the first volute when an air output volume of the air conditioner is maximum, and a width of the set air duct in the cross section is first increased and then decreased along an air output direction. The air conditioner according to the present application may improve the air volume, the air supply range, and the air supply distance.

In some embodiments, in the cross section, two side wall surfaces of the set air duct in a width direction are smooth curved surfaces.

In some embodiments, in the cross section, the first volute has an outer end point M, the second volute has an outer end point N, a base circle is drawn with a point O as a center of the circle and R as a radius, the pivot axis has a projection point Oo located in the base circle, a vertical line is drawn towards a line segment MN through the point O to obtain a perpendicular foot point K, two end points of the air guide member in a rotation circumferential direction are P and Q, and a vertical line is drawn towards a perpendicular bisection line L of a line segment PQ through the point Oo to obtain a perpendicular foot point B, wherein $0.4MN \le MK \le 0.6MN$, $0.25MK \le KO \le 0.85MK$, $0.35KO \le R \le 0.75KO$, $PQ \le 0.9MN$, and $OoB \le 0.5R$.

In some embodiments, the air guide member includes an air guide surface and an outer finishing surface, and the air guide member has a first air guide state and a second air guide state, wherein in the first air guide state, the air guide surface is located on a side of the outer finishing surface close to the first volute, and a first air outlet duct is formed between the air guide surface and the first volute; in the second air guide state, the air guide surface is located on a side of the outer finishing surface close to the second volute, and a second air outlet duct is formed between the air guide surface and the second volute, and wherein in the rotation circumferential direction of the air guide member, a distance between the air guide surface and the outer finishing surface is first increased and then decreased.

In some embodiments, the air guide surface is a curved surface and has a curvature of $\rho 1$, and the outer finishing surface includes a curved surface section with a curvature of $\rho 2$, wherein $0<\rho 1<\rho 2 \le 0.03$.

In some embodiments, the outer finishing surface further includes two inclined surface sections connected to two ends of the curved surface section, respectively, and an included angle $\alpha$ between each inclined surface section and a tangent line of the curved surface section satisfies $0° \le \alpha \le 25°$.

In some embodiments, during rotation of the air guide member, the air guide member is rotatable into the cross-flow air duct, a minimum gap between the air guide member and a side surface of the first volute facing the second volute is $\delta 1$, and a minimum gap between the air guide member and a side surface of the second volute facing the first volute is $\delta 2$, wherein $\delta 1 \ge 4$ mm, and $\delta 2 \ge 4$ mm.

In some embodiments, the air guide member includes an inner air guide plate and an outer air guide plate, and two ends of the inner air guide plate in a rotation circumferential direction are correspondingly connected to two ends of the outer air guide plate in the rotation circumferential direction, to form a cavity between the inner air guide plate and the outer air guide plate.

In some embodiments, the two ends of the inner air guide plate in the rotation circumferential direction are correspondingly connected to the two ends of the inner air guide plate in the rotation circumferential direction by snap joints.

In some embodiments, a surface assembly gap W between the inner air guide plate and the outer air guide plate is less than or equal to 0.5 mm.

In some embodiments, the first volute includes a first linear section, a volute tongue section connected to an inner end of the first linear section, and a first flared section connected to an outer end of the first linear section; the second volute includes a second linear section and a second flared section connected to an outer end of the second linear section, wherein the first flared section extends first from inside to outside in a direction away from an extension line of the first linear section and then towards the extension line of the first linear section, and the second flared section extends from inside to outside in a direction away from an extension line of the second linear section.

In some embodiments, the air conditioner is a mobile air conditioner, the first flared section is located at a rear side of the second flared section, an upper end of the first flared section is an outer end of the first volute, an upper end of the second flared section is an outer end of the second volute, and the upper end of the first flared section is higher than the upper end of the second flared section.

In some embodiments, the air conditioner is configured as an indoor wall-mounted air conditioner, the first flared section is located at an upper side of the second flared section, a front end of the first flared section is configured as an outer end of the first volute, a front end of the second flared section is configured as an outer end of the second volute, and the front end of the first flared section is located in front of the front end of the second flared section.

Additional aspects and advantages of the present application will be given in part in the following descriptions, become apparent in part from the following descriptions, or be learned from the practice of the embodiments of the present application.

Figure 1:
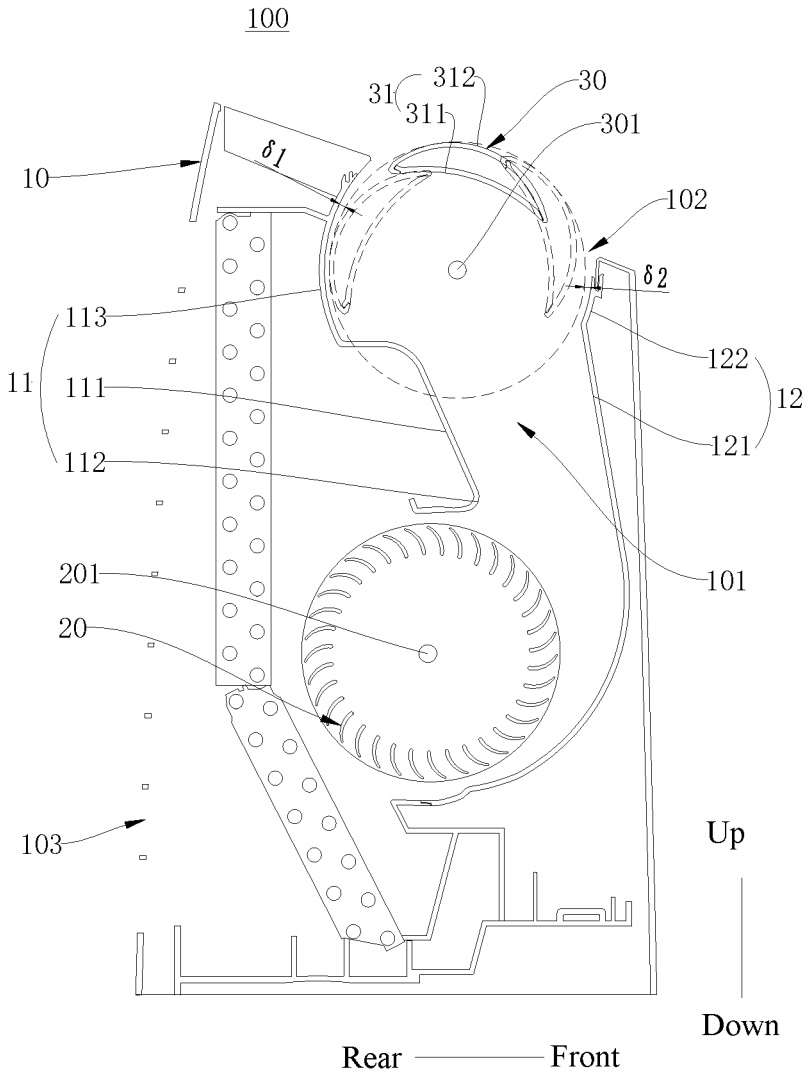
FIG. 1 is a sectional view of an air conditioner according to one embodiment of the present application.

REFERENCE NUMERALS air conditioner 100;
- air conditioner body 10;
  - cross-flow air duct 101; first air outlet duct 1011; second air outlet duct 1012; set air duct 1013;
  - air outlet 102; air inlet 103;
  - first volute 11; first linear section 111; extension line S1 of first linear section;
    - volute tongue section 112; first flared section 113;
  - second volute 12; second linear section 121; extension line S2 of second linear section;
    - second flared section 122;
- cross-flow impeller 20; rotation axis 201;
- air guide assembly 30; pivot axis 301; air guide member 31;
  - air guide surface 311; extension line S3 of air guide surface;
  - outer finishing surface 312; curved surface section 3121; inclined surface section 3122;
  - inner air guide plate 31*a*; outer air guide plate 31*b*; cavity 31*c*.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and intended for explaining the present application. The embodiments shall not be construed to limit the present application.

The following disclosure provides many different embodiments or examples for implementing different structures of the present application. In order to simplify the disclosure of the present application, the components and arrangements of the specific examples are described below. Of course, they are merely examples and are not intended to limit the present application. In addition, the present application may be repeated with reference to the numerals and/or reference numerals in the various examples. This repetition is for the purpose of simplicity and clarity, and does not indicate the relationship between the various embodiments and/or arrangements discussed. Moreover, the present application provides examples of various specific processes and materials, but one of ordinary skill in the art will recognize the applicability of other processes and/or the use of other materials.

An air conditioner 100 according to the embodiments of the present application will be described below with reference to the drawings.

As shown in FIG. 1, the air conditioner 100 according to the embodiments of the present application includes an air conditioner body 10, a cross-flow impeller 20 and an air guide assembly 30. The air conditioner body 10 has a cross-flow air duct 101 and an air outlet 102 in communication with the cross-flow air duct 101, and the cross-flow impeller 20 is provided in the cross-flow air duct 101 and located upstream of the air outlet 102. Thus, when the cross-flow impeller 20 is rotated, airflow may enter the cross-flow air duct 101 and then be fed out of the air conditioner body 10 from the air outlet 102.

It should be noted that a specific configuration of the air conditioner body 10 according to the embodiments of the present application is not limited herein and is required to be determined according to a specific type of the air conditioner 100. In addition, in some embodiments of the present application, the air conditioner body 10 may further have an air inlet 103 in communication with the cross-flow air duct 101, and the cross-flow impeller 20 is provided in the cross-flow air duct 101 and located downstream of the air inlet 103, such that when the cross-flow impeller 20 is rotated, air outside the air conditioner body 10 may enter the air conditioner body 10 from the air inlet 103, then enter the cross-flow air duct 101, and then be fed out of the air conditioner body 10 from the air outlet 102.

As shown in FIG. 1, on a cross section perpendicular to a rotation axis 201 of the cross-flow impeller 20 (that is, the cross section is perpendicular to the rotation axis 201 of the cross-flow impeller 20), for example, in the cross section shown in FIG. 1, the air conditioner body 10 includes a first volute 11 and a second volute 12 arranged oppositely, and the cross-flow air duct 101 is located between the first volute 11 and the second volute 12. It should be noted that the first volute 11 may be configured as an integral piece or formed by splicing a plurality of parts, and the second volute 12 may be configured as an integral piece or formed by splicing a plurality of parts, which are determined according to the specific type of the air conditioner body 10, and will not be limited herein.

Figure 5:
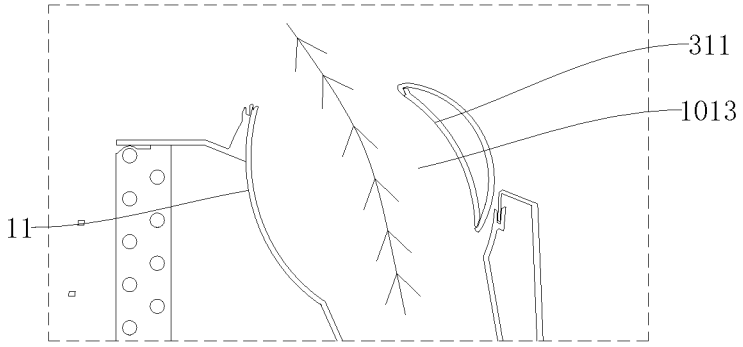
FIG. 5 is still another state diagram of the air conditioner shown in FIG. 2 including the air guide member.
Figure 6:
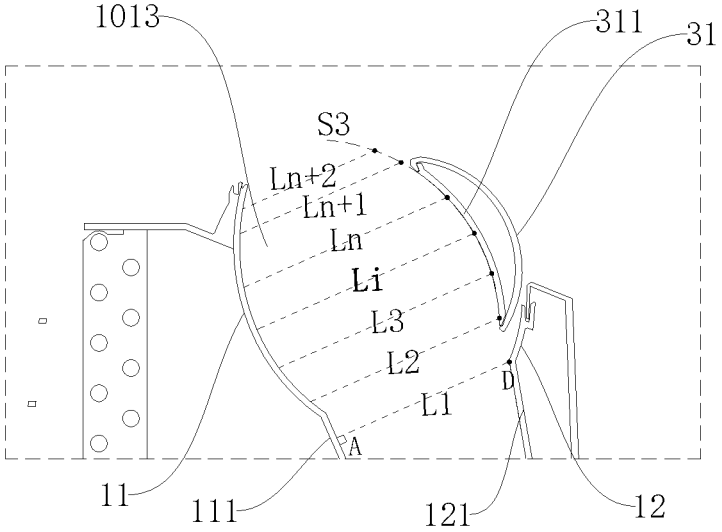
FIG. 6 is a variation analysis diagram of a cross-sectional width of a first air outlet duct shown in FIG. 5.

As shown in FIG. 1, the air guide assembly 30 includes an air guide member 31 rotatable about a pivot axis 301 at the air outlet 102, for example, dashed lines in FIG. 1 represent some rotatable positions of the air guide member 31. When an air output volume of the air conditioner 100 is maximum, as shown in FIGS. 5 and 6, a set air duct 1013 is formed between the air guide member 31 and the first volute 11, and the width of the set air duct 1013 on the above-mentioned cross section is first increased and then decreased along an air output direction. That is, when the air output volume of the air conditioner 100 is maximum, the cross-sectional width of the set air duct 1013 is formed into a structural shape that first expands and then contracts along the air output direction.

It should be noted that the air output volume of the air conditioner 100 may be actually measured or obtained by numerical simulation, and it may be understood that the air volume is different according to the specific type of the air conditioner 100. In addition, the width of the set air duct 1013 on the above-mentioned cross section refers to a width perpendicular to an airflow direction at an inlet of the set air duct 1013 in the cross section, for example, L2, L3 . . . Li . . . Ln shown in the drawings.

Based on the Bernoulli equation, a sum of static pressure and dynamic pressure is a constant, and when the airflow in the cross-flow air duct 101 reaches the set air duct 1013, a following process may be successively divided into two stages: in the first stage, the cross-sectional width of the set air duct 1013 is increased gradually, and based on an unchanged flow rate and the increased width of a flow channel, a speed of the airflow is decreased, such that the dynamic pressure of the airflow is decreased, and the static pressure is increased; in the second stage, the cross-sectional width of the set air duct 1013 is decreased gradually, that is, the width of the flow channel is decreased, such that the speed of the airflow is increased, and the dynamic pressure of the airflow is increased; and thus, the static pressure and the dynamic pressure of the outlet air may be increased, that is, blocking resistance of the outlet air is improved, and an air supply distance is long.

In an air conditioner in the related art, such as a mobile air conditioner, a window air conditioner, a wall-mounted air conditioner, or the like, a cross-flow air duct component is adopted, a cross-flow impeller is rotated for primary pressurization, and air is discharged through a cross-flow air duct and guided by an air guide plate at an air outlet to meet requirements of air supply angles. However, in a guide stage of the air guide plate, due to a forced change of an airflow deflecting angle, the airflow deflecting angle has a large magnitude, air pressure is reduced quickly, an air supply distance is shortened, and an air volume is reduced, thus adversely affecting a heat exchange effect.

In the air conditioner 100 according to the embodiments of the present application, when the air output volume of the air conditioner 100 is maximum, the cross-sectional width of the set air duct 1013 between an air guide surface 311 and the first volute 11 is first increased and then decreased along the air output direction, such that primary pressurization may be realized by rotation of the cross-flow impeller 20 to form a stable airflow field; and when the airflow flows into the set air duct 1013, the static pressure and the dynamic pressure of the outlet air may be increased, thereby realizing secondary pressurization, improving the blocking resistance of the outlet air, meeting requirements of large-air-volume, large-range and long-distance air supply, and solving problems of air volume attenuation, a small air supply range and a short air supply distance.

Figure 2:
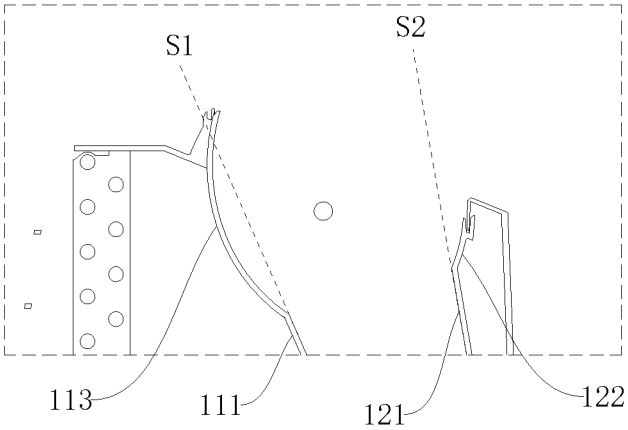
FIG. 2 is a partial sectional view of an air conditioner according to another embodiment of the present application, in which an air guide member is not shown.

In some embodiments, as shown in FIG. 1, the first volute 11 includes a first linear section 111, a volute tongue section 112 connected to an inner end of the first linear section 111, and a first flared section 113 connected to an outer end of the first linear section 111, the second volute 12 includes a second linear section 121 and a second flared section 122 connected to an outer end of the second linear section 121, and referring to FIG. 2, the first flared section 113 extends first from inside to outside in a direction away from an extension line S1 of the first linear section and then towards the extension line S1 of the first linear section, and the second flared section 122 extends from inside to outside in a direction away from an extension line S2 of the second linear section. It should be noted that "inside" described in this paragraph refers to a direction in the airflow direction close to the inlet of the cross-flow air duct 101, and "outside" refers to a direction in the airflow direction close to the outlet of the cross-flow air duct 101.

Thus, by setting shapes of the first volute 11 and the second volute 12 as described above, referring to FIG. 2, most or all of the first flared section 113 and the second flared section 122 may be located on two sides of the extension line S1 of the first linear section and the extension line S2 of the second linear section respectively, such that an outer end portion of the cross-flow duct 101 has a flared shape to increase the air outlet area of the cross-flow air duct 101 at this position, thereby increasing the air output volume. In short, through the design of the first flared section 113 and the second flared section 122, the outer end portion of the cross-flow air duct 101 has the flared shape to increase the air outlet area of the cross-flow air duct 101 at this position, thereby increasing the air output volume.

With reference to FIG. 6, when the first volute 11 and the second volute 12 are configured as described above, on the above-mentioned cross section, a vertical line segment is drawn from an outer end point D of the second linear section 121 to the first linear section 111 to obtain a perpendicular foot A, AD has a length L1, and based on the vertical line segment, a plurality of straight lines parallel to the vertical line segment are drawn, and lengths of line segments of the straight lines between the first volute 11 and the air guide surface 311 of the air guide member 31, for example, L2, L3 . . . Li . . . Ln shown in FIG. 6, are the widths of various positions of the set air duct 1013 on the above-mentioned cross section.

Further, in some embodiments of the present application, when the air output volume of the air conditioner 100 is maximum, the cross-sectional width between an extension line S3 of the air guide surface and the first volute 11, for example, Ln+1 and Ln+2 shown in FIG. 6, is continuously decreased gradually along the air output direction relative to the outlet cross-sectional width Ln of the set air duct 1013. Thus, the secondary pressurization of the outlet airflow may be better realized, and total pressure of the outlet air is increased, that is, the blocking resistance of the outlet air is improved, such that the air supply distance is long.

Figure 7:
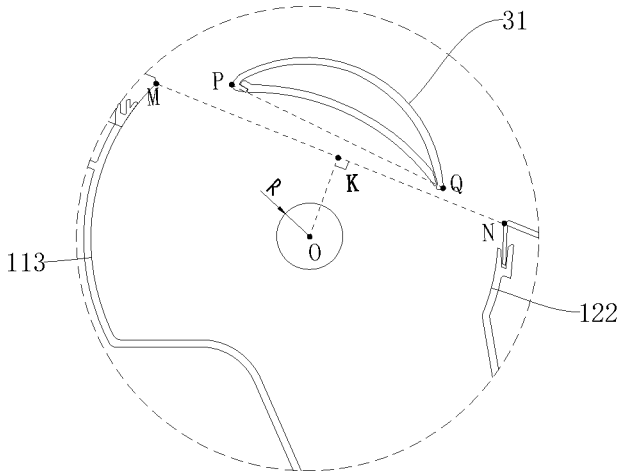
FIG. 7 is a partial sectional view of an air conditioner according to another embodiment of the present application.
Figure 8:
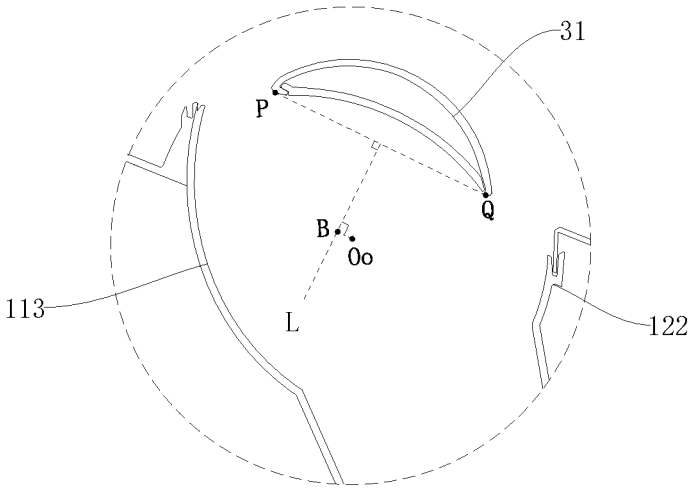
FIG. 8 is a partial sectional view of an air conditioner according to another embodiment of the present application.

As shown in FIG. 7, in the cross section perpendicular to the rotation axis 201 of the cross-flow impeller 20, the first volute 11 has an outer end point M (for example, the outer end point of the first flared section 113 shown in FIG. 7), the second volute 12 has an outer end point N (for example, the outer end point of the second flared section 122 shown in FIG. 7), a base circle is drawn with a point O as a center of the circle and R as a radius, the pivot axis 301 has a projection point Oo located in the base circle, a vertical line is drawn towards a line segment MN through the point O to obtain a perpendicular foot point K, the two end points of the air guide member 31 in a rotation circumferential direction are P and Q respectively, referring to FIG. 8, a perpendicular bisection line L of a line segment PQ is drawn, a vertical line is drawn towards the perpendicular bisection line L through the point Oo to obtain a perpendicular foot point B, $0.4MN \leq MK \leq 0.6MN$, $0.25MK \leq KO \leq 0.85MK$, $0.35KO \leq R \leq 0.75KO$, $PQ \leq 0.9MN$, and $OoB \leq 0.5R$.

Thus, in the present application, the above-mentioned parameters are set ingeniously, the position of the pivot axis 301 of the air guide member 31 is set as above, and meanwhile, a circumferential width of the air guide member 31 is designed correspondingly, thereby effectively ensuring that when the air output volume of the air conditioner 100 is maximum, the width of the set air duct 1013 in the cross section is first increased and then decreased in the air output direction, thus giving consideration to the large air volume, low noise and the large air supply range to meet requirements of heating and cooling comfort.

For example, as shown in FIG. 1, when the air conditioner 100 is configured as a mobile air conditioner, the first flared section 113 is located at a rear side of the second flared section 122, an upper end of the first flared section 113 is configured as an outer end of the first volute 11, an upper end of the second flared section 122 is configured as an outer end of the second volute 12, and the upper end of the first flared section 113 is higher than the upper end of the second flared section 122. Thus, when the air guide member 31 is rotated to a position close to the second flared section 122 on the front side, a rear surface of the air guide member 31 serves as the air guide surface 311, such that a first air outlet duct 1011 located on the rear side of the air guide member 31 is formed between the air guide surface and the first volute 11, so as to achieve backward air supply (with reference to FIG. 3), and when the air guide member 31 is rotated to a position close to the first flared section 113 on the rear side, a front surface of the air guide member 31 serves as the air guide surface 311, such that a second air outlet duct 1011 located on the front side of the air guide member 31 is formed between the air guide surface and the second volute 12, so as to achieve forward air supply (with reference to FIG. 4).

At this point, by setting the above-mentioned parameters as above, (1) the mobile air conditioner according to the present application may have a strong-air-level air volume increased to 600 cubic meters, which is increased by 33.3% compared with the conventional mobile air conditioner with the maximum air volume of 450 cubic meters; (2) the mobile air conditioner according to the present application may have an air supply distance of 11.0 m, and ultra-far air supply is realized, while the air supply distance of the conventional mobile air conditioner under the same test condition is only 5.0 m; and (3) the mobile air conditioner according to the present application may have a swing range of 180 degrees, the whole house may be supplied with air without dead angles, and the conventional mobile air conditioner is only able to realize an air sweep in a range of 30 degrees right ahead of the product. It should be noted that other configurations (such as a heat exchanger, a chassis, a surface frame, a panel, or the like) and operations of the mobile air conditioner according to the embodiments of the present application are known to those skilled in the art and will not be described in detail herein.

Figure 9:
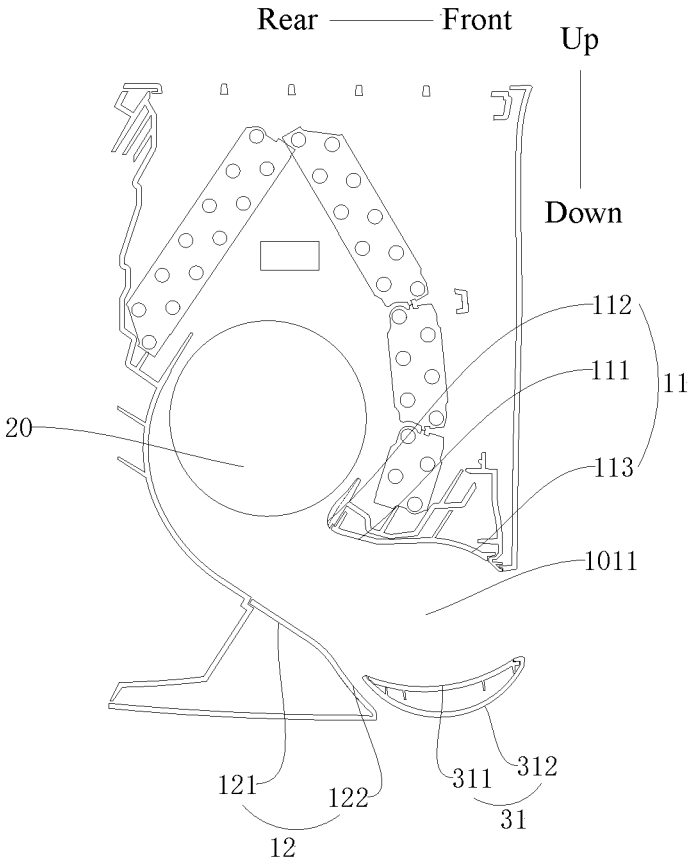
FIG. 9 is a sectional view of an air conditioner according to another embodiment of the present application.
Figure 10:
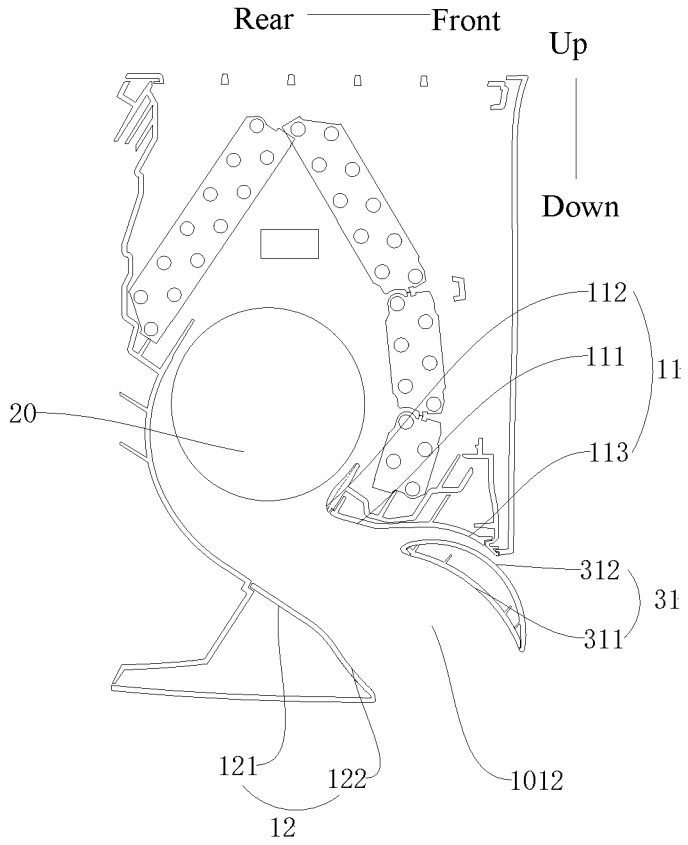
FIG. 10 is a state diagram showing the air guide member shown in FIG. 9 has rotated to another position.

For example, as shown in FIG. 9, the air conditioner 100 is configured as an indoor wall-mounted air conditioner, the first flared section 113 is located at a front side of the second flared section 122, a front end of the first flared section 113 is configured as the outer end of the first volute 11, a front end of the second flared section 122 is configured as the outer end of the second volute 12, and the front end of the first flared section 113 is located on the front side of the front end of the second flared section 122. Thus, when the air guide member 31 is rotated to a position close to the second flared section 122 at the lower portion, an upper surface of the air guide member 31 serves as the air guide surface 311, such that the first air outlet duct 1011 located above the air guide member 31 is formed between the air guide surface and the first volute 11, so as to achieve upward air supply (with reference to FIG. 9), and when the air guide member 31 is rotated to a position close to the first flared section 113 at the upper portion, a lower surface of the air guide member 31 serves as the air guide surface 311, such that the second air outlet duct 1011 located on below the air guide member 31 is formed between the air guide surface and the second volute 12, so as to achieve downward air supply (with reference to FIG. 10).

At this point, by setting the above-mentioned parameters as above, (1) the indoor wall-mounted air conditioner according to the present application may have a strong-air-level air volume increased to 750 cubic meters, which is increased by 10.3% compared with the conventional indoor wall-mounted air conditioner with the maximum air volume of 680 cubic meters; (2) the indoor wall-mounted air conditioner according to the present application may have an air supply distance of 9.0 m, and ultra-far air supply is realized, while the air supply distance of the conventional indoor wall-mounted air conditioner under the same test condition is only 7.5 m; and (3) the indoor wall-mounted air conditioner according to the present application may have a swing range of 180 degrees, the whole house may be supplied with air without dead angles, and the conventional indoor wall-mounted air conditioner is only able to realize an air sweep in a range of 75 degrees. It should be noted that other configurations (such as a heat exchanger, a chassis, a surface frame, a panel, or the like) and operations of the indoor wall-mounted air conditioner according to the embodiments of the present application are known to those skilled in the art and will not be described in detail herein.

Figure 3:
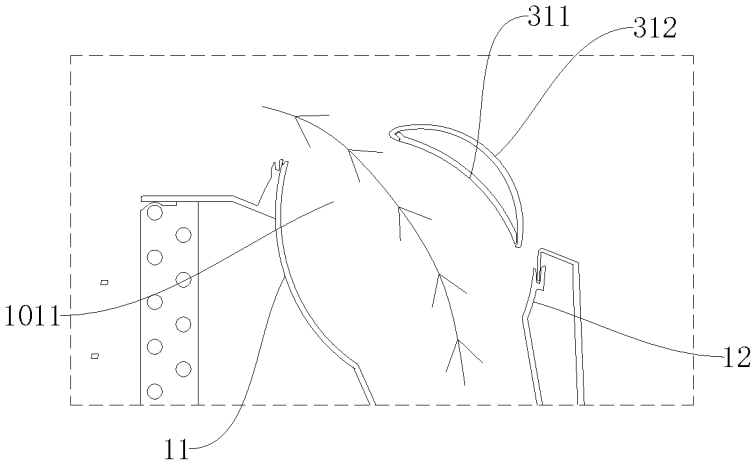
FIG. 3 is a state diagram of the air conditioner shown in FIG. 2 including the air guide member.
Figure 4:
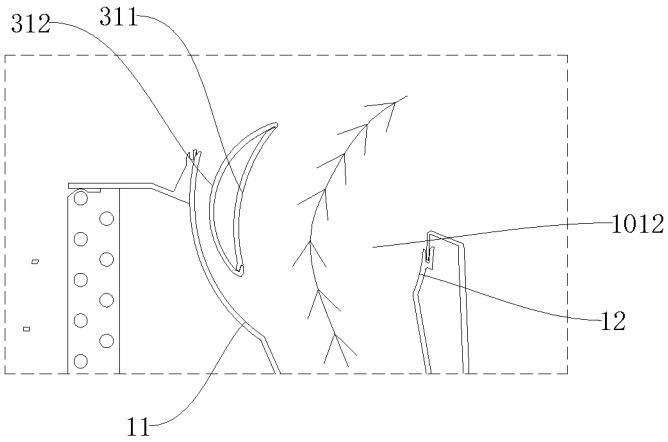
FIG. 4 is another state diagram of the air conditioner shown in FIG. 2 including the air guide member.

In some embodiments, as shown in FIG. 1, the air guide member 31 includes the air guide surface 311 and an outer finishing surface 312, and has a first air guide state and a second air guide state; as shown in FIG. 3, in the first air guide state, the air guide surface 311 is located on the side of the outer finishing surface 312 close to the first volute 11, and the first air outlet duct 1011 is formed between the air guide surface 311 and the first volute 11; and in the second air guide state, the air guide surface 311 is located on the side of the outer finishing surface 312 close to the second volute 12, and the second air outlet duct 1012 is formed between the air guide surface 311 and the second volute 12.

It may be understood that, during rotation of the air guide member 31 around the pivot axis 301, a position where the air guide member 31 maximally shields the air outlet 102 is defined as an initial position, and when the air guide member 31 is located on the side of the initial position close to the second volute 12 and away from the first volute 11, or rotates in a rotation angle range (referred to as a first angle range), the first air outlet duct 1011 may be formed between the air guide surface 311 and the first volute 11, and at this point, the air guide member 31 is in the first air guide state; that is, the air guide member 31 in the first air guide state does not correspond to one angle, but corresponds to multiple angles.

Similarly, during the rotation of the air guide member 31 around the pivot axis 301, when the air guide member 31 is located on the side of the initial position close to the first volute 11 and away from the second volute 12, or rotates in a rotation angle range (referred to as a second angle range), the second air outlet duct 1012 may be formed between the air guide surface 311 and the second volute 12, and at this point, the air guide member 31 is in the second air guide state; that is, the air guide member 31 in the second air guide state does not correspond to one angle, but corresponds to multiple angles. Furthermore, it should be noted that, according to different types of the air conditioner 100, specific values of the first angle range and the second angle range may be set according to practical situations and will not be limited herein.

Thus, it may be understood that when the air output volume of the air conditioner 100 is maximum, the set air duct 1013 is formed between the air guide member 31 and the first volute 11, and therefore, the set air duct 1013 is configured as one specific first air outlet duct 1011; that is, when the air guide member 31 is in the first air guide state and is rotated to a set angular position, the first air outlet duct 1011 formed between the air guide member 31 and the first volute 11 is configured as the set air duct 1013. Furthermore, it should be noted that when the air output volume is maximum, the specific set angular position to which the air guide member 31 is rotated may be different, and therefore, the set angular position is not limited.

In some embodiments, as shown in FIG. 1, in a rotation circumferential direction of the air guide member 31 (which may be a direction towards the first volute 11 and away from the second volute 12, such as the counterclockwise direction shown in FIG. 1, or a direction towards the second volute 12 and away from the first volute 11, such as the clockwise direction shown in FIG. 1), a distance between the air guide surface 311 and the outer finishing surface 312 is first increased and then decreased. Thus, on the premise of ensuring that the structural shape of the set air duct 1013 meets the above-mentioned requirements, a certain distance is formed between the air guide surface 311 and the outer finishing surface 312, thereby improving the problem of condensation at the air guide member 31.

In some embodiments, as shown in FIGS. 5 and 6, the two side wall surfaces of the set air duct 1013 in a width direction are configured as smooth curved surfaces, for example, in the examples shown in FIGS. 5 and 6, the side surface of the first flared section 113 facing the second flared section 122 and the air guide surface 311 are both configured as smooth curved surfaces. Thus, when the air output volume of the air conditioner 100 is maximum, the two side surfaces of the set air duct 1013 in the width direction are configured as streamline curved surfaces, and the cross section of the set air duct 1013 may be approximately spherical, such that the cross-sectional width of the set air duct 1013 may realize a smooth transition from gradual increase to gradual decrease, thereby better realizing the secondary pressurization. Certainly, the present application is not limited thereto, and in other embodiments of the present application, the side surface of the first flared section 113 facing the second flared section 122 and the air guide surface 311 may also be configured as non-smooth curved surfaces, for example, broken-line curved surfaces, or the like, which are not repeated herein.

Figure 11:
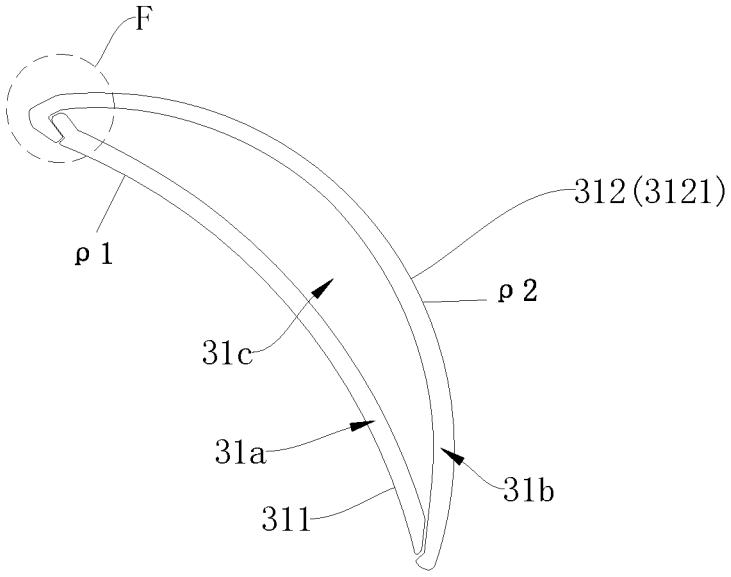
FIG. 11 is a sectional view of an air guide member according to one embodiment of the present application.

In the example shown in FIG. 11, the air guide surface 311 may be configured as a curved surface and have a curvature $\rho 1$, the outer finishing surface 312 may include a curved surface section 3121 with a curvature $\rho 2$, and $0<\rho 1<\rho 2\leq 0.03$. Thus, the air guide surface 311 and the outer finishing surface 312 of the air guide member 31 both accord with the wall attachment effect, such that the airflow is partially accelerated, is in positive pressure and may completely wrap the air guide member 31, thus avoiding that the airflow breaks away from the surface of the air guide member 31 to form a vortex, that is, avoiding that water drops are formed by cold and hot intersection, and solving the problem that the condensation is formed at the air guide member 31.

Figure 12:
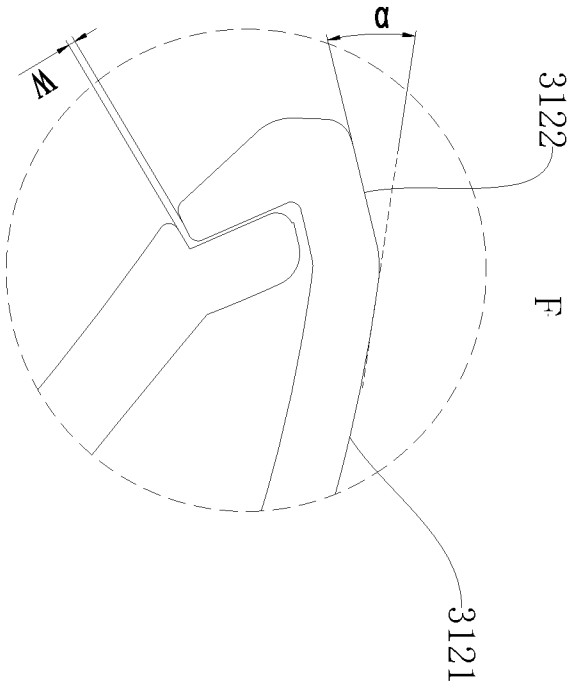
FIG. 12 is a partial enlarged view of portion F circled in FIG. 11.

With reference to FIG. 12, the outer finishing surface 312 further includes two inclined surface sections 3122 connected to two ends of the curved surface section 3121 respectively; that is, the inclined surface sections 3122 are connected to the two ends of the curved surface section 3121 in an arc length direction respectively, the inclined surface section 3122 and a tangent line of the curved surface section 3121 (that is, a tangent line at the corresponding ends of the inclined surface section 3122 and the curved surface section 3121) has an included angle $\alpha$, and $0°\leq\alpha\leq 25°$. Thus, by designing the non-curved sections at both ends of the outer finishing surface 312 and forming the included angle $\alpha$ with the curved surface section 3121, the outer finishing surface 312 accords with the wall attachment effect, such that the airflow is partially accelerated, is in the positive pressure and may completely wrap the air guide member 31, thus avoiding that the airflow breaks away from the surface of the air guide member 31 to form the vortex, that is, avoiding that the water drops are formed by cold and hot intersection, and solving the problem that the condensation is formed at the air guide member 31.

With reference to FIG. 1, during the rotation of the air guide member 31, the air guide member 31 may be rotated into the cross-flow air duct 101; that is, the air guide member 31 may be rotated to the side of the first volute 11 facing the second volute 12, at this point, the outer finishing surface 312 of the air guide member 31 is in clearance fit with the side surface of the first volute 11 facing the second volute 12, as shown in FIG. 1, and at this point, the outer finishing surface 312 and the side surface of the first volute 11 facing the second volute 12 have a minimum clearance $\delta 1$; and the air guide member 31 may also be rotated to the side of the second volute 12 facing the first volute 11, at this point, the outer finishing surface 312 of the air guide member 31 is in clearance fit with the side surface of the second volute 12 facing the first volute 11, as shown in FIG. 1, and at this point, the outer finishing surface 312 and the side surface of the second volute 12 facing the first volute 11 have a minimum clearance $\delta 2$. Or, a dotted circle is drawn through the point on the outer finishing surface 312 farthest from the pivot axis 301, the dotted circle and the first volute 11 have the minimum clearance $\delta 1$, the dotted circle and the second volute 12 have the minimum clearance $\delta 2$, $\delta 1\geq 4$ mm, and $\delta 2\geq 4$ mm.

Thus, the above design of the rotation clearance ensures that the airflow may flow along the surface of the air guide member 31, which accords with the wall attachment effect, thereby guaranteeing formation of the secondary pressurization and increasing an airflow speed, such that the airflow is partially accelerated, is in the positive pressure and may completely wrap the air guide member 31, thus avoiding that the airflow breaks away from the surface of the air guide member 31 to form the vortex, that is, avoiding that the water drops are formed by cold and hot intersection, and solving the problem that the condensation is formed at the air guide member 31.

In short, the configurations of the surface curvature of the air guide member 31, the clearance between the air guide member 31 and the wall surface of the cross-flow air duct 101, or the like can ensure that the airflow is partially accelerated and is in the positive pressure, an attack angle between the airflow and the air guide member 31 is controlled within 10 degrees, the problem that cold air is unable to wrap the air guide member 31 is solved, the vortex formed when the airflow breaks away from the wall surface is guaranteed to be avoided, the water drops formed by cold and hot intersection are avoided, and the problem of the condensation at the air outlet 102 is solved.

When the air conditioner in the related art is in a low-air and high-frequency state, the air guide plate tends to be supercooled to form condensation which tends to drop along an appearance surface of the air guide plate, thus influencing normal use of a user. In some embodiments of the present application, as shown in FIGS. 11 and 12, the air guide member 31 may include an inner air guide plate 31*a* and an outer air guide plate 31*b*, an inner surface of the inner air guide plate 31*a* serves as the air guide surface 311, an outer surface of the outer air guide plate 31*b* serves as the outer finishing surface 312, and the two ends of the inner air guide plate 31*a* in the rotation circumferential direction are correspondingly connected with the two ends of the outer air guide plate 31*b* in the rotation circumferential direction, such that a cavity 31*c* is formed between the inner and outer air guide plates 31*a*, 31*b*. Thus, the formation of the closed air cavity between the inner and outer air guide plates 31*a*, 31*b* may achieve a heat preservation effect and avoid cold and hot intersection; or air interlayer heat preservation may avoid supercooling of the air guide surface 311 or the outer finishing surface 312, and the condensation and water dripping problem of the air guide member 31 is solved in principle.

It should be noted that the cavity 31*c* may be configured to accommodate air or a heat insulation material, and when the air is accommodated, the closed air cavity may be formed between the inner and outer air guide plates 31*a*, 31*b* to obtain the heat preservation effect, a weight of the air guide member 31 is reduced, a cost of the air guide plate is reduced, and processing and assembly processes of the air guide member 31 are simplified. When the heat insulation material is accommodated, the heat preservation effect may be improved to further prevent the condensation.

In some embodiments of the present application, as shown in FIGS. 11 and 12, the two ends of the inner air guide plate 31*a* in the rotation circumferential direction are correspondingly connected with the two ends of the inner air guide plate 31*a* in the rotation circumferential direction by snap joints respectively, thus simplifying assembly, implementing disassembly and maintenance, or adding or reducing the heat insulation material between the inner and outer air guide plates 31*a*, 31*b* as required. Certainly, the present application is not limited thereto, and the inner and outer air guide plates 31*a*, 31*b* may also be assembled by other methods, such as thermal welding, or the like, which are not repeated herein.

It should be noted that, along the extension direction of the pivot axis 301, the number of the snap joints is not limited and may be multiple, thereby improving connection reliability of the inner and outer air guide plates 31*a*, 31*b*. Furthermore, at the assembly position of the inner and outer air guide plates 31*a*, 31*b*, the inner and outer air guide plates 31*a*, 31*b* may have a surface fit clearance W controlled within 0.5 mm, thereby better guaranteeing an airflow flowing effect.

In addition, it should be noted that the air guide assembly 30 according to the embodiments of the present application includes, in addition to the air guide member 31, a driving device for driving the air guide member 31 to rotate around the pivot axis 301, and a specific configuration of the driving device is not limited, for example, in an example of the present application, two ends of the air guide member 31 may drive an anti-electric shaft to rotate by a stepping motor, and the anti-electric shaft is connected with the air guide member 31 by a bearing seat, thereby achieving rotation of the air guide member 31.

In the description of the present application, it is to be understood that terms such as "upper," "lower," "front" and "rear" should be construed to refer to the orientation as shown in the drawings. These relative terms are for convenience of description and do not require that the present application be constructed or operated in a particular orientation, thus cannot be construed to limit the present application.

In addition, the terms such as "first" and "second" are used herein for purposes of description and are not intended to indicate or imply relative importance or significance or to imply the number of indicated technical features. Thus, the feature associated with "first" and "second" may include one or more of this feature explicitly or implicitly. In the description of the present application, "a plurality of" means two or more unless otherwise specified.

In the description of the present specification, reference throughout this specification to "an embodiment," "some embodiments," "example," "specific example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and features in different embodiments or examples described in the specification, without mutual contradictions.

Although embodiments of the present application have been shown and illustrated, it shall be understood by those skilled in the art that various changes, modifications, alternatives and variants without departing from the principle and idea of the present application are acceptable. The protection scope of the present application is defined by the claims and their equivalents.

What is claimed is:

1. An air conditioner comprising:

an air conditioner body including a cross-flow air duct and an air outlet in communication with the cross-flow air duct;

a cross-flow impeller arranged at the cross-flow air duct and located upstream of the air outlet; and an air guide assembly including an air guide member rotatable around a pivot axis at the air outlet;

wherein:

the air conditioner body includes a first volute and a second volute arranged opposite to each other in a cross section perpendicular to a rotation axis of the cross-flow impeller;

the cross-flow air duct is located between the first volute and the second volute; and a set air duct is formed between the air guide member and the first volute when an air output volume of the air conditioner is maximum, and a width of the set air duct in the cross section first increases and then decreases along an air output direction.

2. The air conditioner according to claim 1, wherein in the cross section, two side wall surfaces of the set air duct in a width direction are smooth curved surfaces.

3. The air conditioner according to claim 1, wherein in the cross section:

a projection point Oo of the pivot axis on the cross section is located within a base circle having a circle center point O and a radius R; and the projection point Oo, the circle center point O, the radius R, an outer end point M of the first volute, an outer end point N of the second volute, a perpendicular foot point K obtained by drawing a vertical line towards a line segment MN through the circle center point O, two end points P and Q of the air guide member in a rotation circumferential direction, and a perpendicular foot point B obtained by drawing a vertical line through the point Oo towards a perpendicular bisection line of a line segment PQ satisfy following relationships:

$$0.4MN \le MK \le 0.6MN,$$

$$0.25MK \le KO \le 0.85MK,$$

$$0.35KO \le R \le 0.75KO,$$

$$PQ \le 0.9MN, \text{ and}$$

$$OoB \le 0.5R.$$

4. The air conditioner according to claim 1, wherein:

the air guide member includes an air guide surface and an outer finishing surface, in a rotation circumferential direction of the air guide member, a distance between the air guide surface and the outer finishing surface first increasing and then decreasing; and the air guide member is configured to rotate to be in:

a first air guide state, in which the air guide surface is located on a side of the outer finishing surface close to the first volute, and a first air outlet duct is formed between the air guide surface and the first volute; and a second air guide state, in which the air guide surface is located on a side of the outer finishing surface close to the second volute, and a second air outlet duct is formed between the air guide surface and the second volute.

5. The air conditioner according to claim 4, wherein the air guide surface includes a curved surface with a curvature of $\rho 1$, the outer finishing surface includes a curved surface section with a curvature of $\rho 2$, $\rho 1$ and $\rho 2$ satisfying $0<\rho 1<\rho 2\le 0.03$.

6. The air conditioner according to claim 5, wherein the outer finishing surface further includes two inclined surface sections connected to two ends of the curved surface section respectively, and an included angle $\alpha$ between each of the inclined surface sections and a tangent line of the curved surface section at a corresponding one of the two ends satisfies $0°\le\alpha\ge 25°$.

7. The air conditioner according to claim 1, wherein:

the air guide member is configured to rotate into the cross-flow air duct;

a minimum gap between the air guide member and a side surface of the first volute facing the second volute is equal to or larger than 4 mm; and a minimum gap between the air guide member and a side surface of the second volute facing the first volute is equal to or larger than 4 mm.

8. The air conditioner according to claim 1, wherein the air guide member includes an inner air guide plate and an outer air guide plate, two ends of the inner air guide plate in a rotation circumferential direction are correspondingly connected to two ends of the outer air guide plate in the rotation circumferential direction, and a cavity is formed between the inner air guide plate and the outer air guide plate.

9. The air conditioner according to claim 8, wherein the two ends of the inner air guide plate in the rotation circumferential direction are correspondingly connected to the two ends of the inner air guide plate in the rotation circumferential direction by snap joints.

10. The air conditioner according to claim 8, wherein a surface assembly gap between the inner air guide plate and the outer air guide plate is less than or equal to 0.5 mm.

11. The air conditioner according to claim 1, wherein:

the first volute includes:

a first linear section; a volute tongue section connected to an inner end of the first linear section; and a first flared section connected to an outer end of the first linear section, the first flared section first extending from inside to outside in a direction away from an extension line of the first linear section and then in a direction towards the extension line of the first linear section; and the second volute includes a second linear section and a second flared section connected to an outer end of the second linear section, the second flared section extending from inside to outside in a direction away from an extension line of the second linear section.

12. The air conditioner according to claim 11, wherein:

the air conditioner is a mobile air conditioner;

the first flared section is located at a rear side of the second flared section;

an upper end of the first flared section is an outer end of the first volute;

an upper end of the second flared section is an outer end of the second volute; and the upper end of the first flared section is higher than the upper end of the second flared section.

13. The air conditioner according to claim 11, wherein:

the air conditioner is an indoor wall-mounted air conditioner;

the first flared section is located at an upper side of the second flared section;

a front end of the first flared section is configured as an outer end of the first volute;

a front end of the second flared section is configured as an outer end of the second volute; and the front end of the first flared section is located in front of the front end of the second flared section.

* * * * *